US009732965B2

(12) United States Patent
Keller

(10) Patent No.: US 9,732,965 B2
(45) Date of Patent: Aug. 15, 2017

(54) BAKING APPLIANCE

(71) Applicant: Miele & Cie. KG, Guetersloh (DE)

(72) Inventor: Uwe Keller, Guetersloh (DE)

(73) Assignee: MIELE & CIE. KG, Guetersloh (DE)

( * ) Notice: Subject to any disclaimer, the term of this patent is extended or adjusted under 35 U.S.C. 154(b) by 169 days.

(21) Appl. No.: 13/627,021

(22) Filed: Sep. 26, 2012

(65) Prior Publication Data

US 2013/0074821 A1 Mar. 28, 2013

(30) Foreign Application Priority Data

Sep. 27, 2011 (EP) ..... 11401598

(51) Int. Cl.

| | |
|---|---|
| ***F24C 15/04*** | (2006.01) |
| ***F24C 15/32*** | (2006.01) |
| ***F24C 15/02*** | (2006.01) |
| ***F24C 15/34*** | (2006.01) |

(52) U.S. Cl.

CPC ..... *F24C 15/04* (2013.01); *F24C 15/02* (2013.01); *F24C 15/025* (2013.01); *F24C 15/32* (2013.01); *F24C 15/34* (2013.01)

(58) Field of Classification Search

CPC ..... F24C 15/02; F24C 15/025; F24C 15/34; F24C 15/32; F24C 15/04

USPC ..... 126/198, 200, 190

See application file for complete search history.

(56) References Cited

U.S. PATENT DOCUMENTS

| | | | | |
|---|---|---|---|---|
| 4,041,930 | A * | 8/1977 | Katona | F24C 15/04 126/198 |
| 5,433,189 | A * | 7/1995 | Bales et al. | 126/198 |
| 6,561,180 | B1 * | 5/2003 | Austin et al. | 126/198 |
| 6,832,487 | B1 * | 12/2004 | Baker | 62/115 |
| 7,547,862 | B2 * | 6/2009 | Kim et al. | 219/400 |
| 7,686,009 | B2 * | 3/2010 | Park et al. | 126/190 |
| 7,703,451 | B2 * | 4/2010 | Bang | 126/190 |
| 7,708,007 | B2 * | 5/2010 | Kim et al. | 126/198 |
| 7,726,295 | B2 * | 6/2010 | Elkasevic | 126/198 |
| 7,856,973 | B2 * | 12/2010 | Kim et al. | 126/273 R |
| 8,028,619 | B2 * | 10/2011 | Lee et al. | 99/474 |
| 8,039,775 | B2 * | 10/2011 | Venezia et al. | 219/399 |

(Continued)

FOREIGN PATENT DOCUMENTS

| | | | |
|---|---|---|---|
| DE | 19802688 | C1 * | 7/1999 |
| DE | 10226657 | A1 * | 1/2004 |

(Continued)

OTHER PUBLICATIONS

European Patent Office, Extended European Search Report in European Patent Application No. 11 40 1598 (Feb. 13, 2012).

*Primary Examiner* — Avinash Savani

*Assistant Examiner* — Aaron Heyamoto

(74) *Attorney, Agent, or Firm* — Leydig, Voit & Mayer, Ltd.

(57) ABSTRACT

A baking appliance includes a heatable baking chamber and a door that closes the baking chamber. The door includes an inner pane facing the baking chamber when the door is closed and an outer pane facing outward when the door is closed. At least one holding element is configured to arrange the inner pane and outer pane so as to form at least one ventilation channel between the inner pane and outer pane. At least one cooling element is associated with the at least one holding element and extends into the at least one ventilation channel.

17 Claims, 2 Drawing Sheets

(56) References Cited

U.S. PATENT DOCUMENTS

| | | | | |
|---|---|---|---|---|
| 8,058,594 | B2 * | 11/2011 | Hwang | 219/757 |
| 8,344,289 | B2 * | 1/2013 | Rogers et al. | 219/394 |
| 2003/0029440 | A1 * | 2/2003 | Gros et al. | 126/200 |
| 2006/0219234 | A1 * | 10/2006 | Larsen | 126/198 |
| 2008/0184984 | A1 * | 8/2008 | Elkasevic | 126/198 |
| 2009/0032010 | A1 * | 2/2009 | Hoffmeier | 126/198 |
| 2013/0019854 | A1 * | 1/2013 | Lim et al. | 126/198 |

FOREIGN PATENT DOCUMENTS

| | | | |
|---|---|---|---|
| EP | 0490774 | A1 | 6/1992 |
| EP | 0940631 | A1 | 9/1999 |
| EP | 1063489 | A2 | 12/2000 |
| WO | WO 2011086506 | A2 | 7/2011 |

* cited by examiner

BAKING APPLIANCE

CROSS REFERENCE TO RELATED APPLICATIONS

This application claims priority to European Application No. EP 11 40 1598.5, filed Sep. 27, 2011, which is hereby incorporated by reference herein in its entirety

FIELD

The present invention relates to a baking appliance having at least one baking chamber and at least one door that closes the baking chamber. The door comprises at least two panes that are arranged on a holding element in such a way that a ventilation channel is formed between them. The holding element is associated with a cooling element. Moreover, the invention relates to a door that closes the baking chamber.

BACKGROUND

In the realm of baking appliances, there is an ever-greater push towards the development of the most energy-efficient and thus environmentally friendly devices possible. In this context, attention is being paid to a particularly effective insulation and good thermal output.

Here, it is particularly the insulation of a heatable baking chamber that plays an important role in two aspects. First of all, the most effective possible insulation of the baking chamber is supposed to yield an especially good energy efficiency in that as little heat as possible is lost to the outside. Secondly, the surfaces and parts of a baking appliance that can be accessed from the outside should be shielded so well against the heat of the baking chamber that there is no risk of injury.

The door of a baking appliance often poses a special challenge in terms of development work. Most doors of baking appliances are fitted with a viewing window. This allows the user to look into the chamber without opening the door since this would cause a great deal of heat energy to be lost. However, the effective insulation of the viewing window is more difficult than, for instance, the insulation of a side wall of the baking appliance.

Adequate cooling is often achieved by a multi-pane structure of the door in which the arrangement of several panes creates spaces through which air can also flow. A problem, however, arises in conjunction with the commonly employed frame parts of the door that are arranged between the outer and inner panes. They can function as a thermal bridge and transmit the heat out of the baking chamber from the inner pane via the frame to the outer pane.

Thus, in the area of the frame construction that supports the various panes of the door, unpleasantly high and, in the worst case scenario, even dangerous temperatures can arise. This is especially the case when the baking chamber is heated to extremely high temperatures such as those that might be encountered, for example, during pyrolysis procedures.

SUMMARY

In an embodiment, the present invention provides a baking appliance includes a heatable baking chamber and a door that closes the baking chamber. The door includes an inner pane facing the baking chamber when the door is closed and an outer pane facing outward when the door is closed. At least one holding element is configured to arrange the inner pane and outer pane so as to form at least one ventilation channel between the inner pane and outer pane. At least one cooling element is associated with the at least one holding element and extends into the at least one ventilation channel.

BRIEF DESCRIPTION OF THE DRAWINGS

Exemplary embodiments of the present invention are described in more detail below with reference to the drawings, in which.

DETAILED DESCRIPTION

Figure 1:
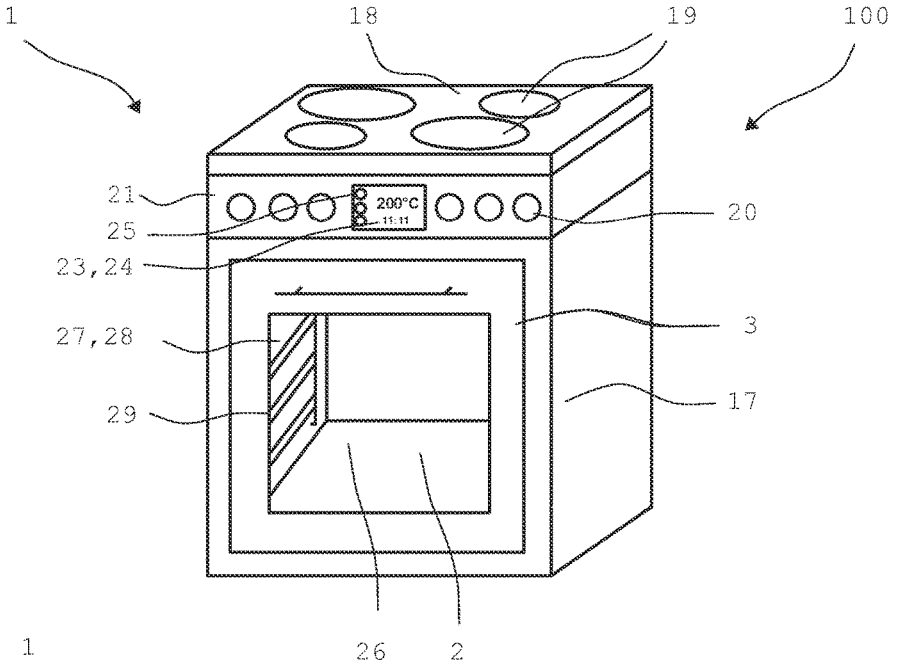
FIG. 1 shows a highly schematic view of a baking appliance according to the invention, which is configured as a stove, in a slightly perspective view.

In an embodiment, the present invention provides a baking appliance and a door for a baking appliance with which a more effective cooling of the entire outer pane of the baking chamber door is achieved.

The baking appliance according to embodiments of the invention include at least one baking chamber and a door that closes the baking chamber. The door comprises at least one inner pane and at least one outer pane. When the door is closed, the inner pane faces the baking chamber. When the door is closed, the outer pane faces outwards. Moreover, at least one holding element is provided for purposes of arranging the at least one inner pane and the at least one outer pane. Here, the panes are arranged in such a way that at least one ventilation channel is formed between the panes. The holding element is associated with at least one cooling element that extends into the ventilation channel.

The term baking appliance refers, for example, to baking appliances such as an oven, a stove, a combination steamer, a steam cooker, a microwave or combinations of various baking appliances.

A baking appliance configured in this manner offers many advantages. One advantage is that, thanks to the cooling element, a large portion of the heat from the holding element can be dissipated. The holding element can at times create an unfavorable thermal bridge between the inner pane and the outer pane. Heat from the holding element can be easily and effectively dissipated, thanks to the arrangement of a heat sink in the ventilation channel, which is also in contact with the holding element in a manner that is effective for the conduction of heat.

The heat transmitted from the holding element to the cooling element can be effectively dissipated by the cooler air flow in the ventilation channel. In this manner, an especially effective cooling is ensured, also in the area of the door frame or of the holding element.

In other advantageous embodiments, more than one inner pane and one outer pane can be provided for the door structure. Then at least one middle pane is preferably provided between the at least one inner pane and the at least one outer pane in such a way that at least one ventilation channel is formed between each of the adjacent panes. As a result, an especially good cooling effect can be achieved for the door.

If a multi-pane structure with several ventilation channels is provided between the outer pane, the inner pane and at least one middle pane, in preferred embodiments, a cooling element is provided at least in the ventilation channel formed with the outer pane.

It is also preferred for the holding element to consist at least partially of profiled sections that are especially configured to be hollow. Special preference is given to the use of profiles made of aluminum and/or of sheet metal and/or of another metal and/or of another heat-resistant material, which can also be enameled. Here, for example, a left door pillar and a right door pillar can be provided in the form of a profiled section or consisting of one or more aluminum profiles on which the panes of the baking chamber door are held.

In advantageous embodiments, the cooling element is held on a profiled section. As a result, an especially good heat dissipation can be achieved.

In order to minimize the heat transmission from the inner pane to the outer pane via the profiled sections to the greatest extent possible, in especially preferred embodiments, at least one profiled section can have at least one slit that extends essentially vertically when the door is closed.

Here, a slit can extend, for example, over the entire length of a profile or else several shorter slits can be provided in one profile and they can also be arranged offset with respect to each other. As a result, the heat transmission from the baking chamber to the outside via the profiled sections can be at least partially interrupted or limited.

Slits in the side facing away from the ventilation channel, or else in the sides on which the panes are held, can be advantageous in certain embodiments. However, it is particularly advantageous if at least one slit is provided on the side of at least one profiled section facing the ventilation channel. In this manner, it can at times even occur that the cooler air flowing through the ventilation channel can penetrate into the slit and thus also bring about additional cooling.

It is preferable for the cooling element and the panes to be spaced at least in part at a distance from each other. In this manner, an especially effective cooling effect can be achieved since no new thermal bridge can be created between the cooling element and the panes.

There is often only a small distance between the cooling element and the pane, so that it is advantageous for the cooling element to be supported against the outer pane, whereby special preference is given to a resilient support. In this manner, it can be achieved that the heat sink will come into contact with a pane, for example, due to imprecise assembly or other influences, which would reduce the cooling effect.

In order to achieve the largest possible cooling surface area in the cooling element, especially preferred embodiments provide a cooling element that makes a large surface area available. For this purpose, the preferred cooling element is one that is essentially V-shaped. Of course, other shapes can also be used advantageously and practically in order to enlarge the surface area of the heat sink. In this context, the cooling element can also have an essentially wave-like shape.

It is also preferred for the cooling element to consist at least partially of a thermally conductive material. In this manner, the dissipation of heat from the holding element can be improved. In particular, materials having a high thermal conductivity or a high heat transfer coefficient are preferred.

In order for the outward appearance of the baking appliance not to be altered by the use of cooling elements in the ventilation channel of a pane, it is also preferred for the cooling element not to extend into the visible area of the door. This can be achieved, for example, in that the cooling elements are arranged behind a darkened area of the pane. Here, it is also advantageous for the cooling elements to utilize the thus available space to the greatest extent possible in order to achieve the most effective cooling effect possible.

The door according to an embodiment of the invention for closing at least one baking chamber opening of a baking appliance comprises at least one inner pane that faces the baking chamber when the door is closed, and at least one outer pane that faces outwards when the door is closed. Moreover, at least one holding element for arranging the at least one inner pane and the at least one outer pane is provided in such a way that at least one ventilation channel is formed between the panes. The holding element is associated with at least one cooling element that extends into the ventilation channel.

The baking chamber door according to the invention also offers many advantages. A major advantage is that the effect of the thermal bridge created by the holding element between an inner pane and an outer pane can be effectively diminished with simple means. As a result, an effective cooling of the baking chamber door is ensured, even at very high baking temperatures, since the heat can easily be dissipated via the cooling element.

The door according to embodiments of the invention can be advantageously refined as set forth in all of the embodiments described above.

FIG. 1 shows a highly perspective view of a baking appliance 1 according to the invention, which is configured here as a stove 100. The stove 100 has a housing 17 on which a baking chamber 2 is provided that can be closed with a door 3. When the door 3 is open, food that is to be baked can be placed into the baking chamber 2.

A cooktop 18 that is divided into several cooking zones 19 is arranged on the stove 100. The desired settings for a cooking procedure on the cooktop 18 or for a baking procedure in the baking chamber 2 can be selected by means of several operating elements 20 on a operating panel 21. A control unit 22 is provided behind the operating panel 21.

The operating panel 21 also comprises a display device 23, which is configured here as a display 24. Various parameters of the baking appliance 1 can be displayed on the display 24, and settings can also be selected via additional operating elements 25. Among other things, the display 24 can show, for instance, the current baking chamber temperature. A clock is also integrated into the display device 23.

The baking chamber 2 of the stove 100 shown here can be heated by various heating methods. For example, top heat and/or bottom heat, a broiler function or else circulating air can be used. Depending on the type of baking appliance 1, other heating methods are also possible such as, for instance, microwave operation or heating by means of gas or steam.

One can look into the baking chamber 2 through a viewing window 26 in the door 3. There, one can see a rack holder 27 that is configured here as a holding rail 28 on the left-hand side of the baking chamber 2. Various racks such as, for example, a cookie sheet, can be slid into the baking levels 29.

Figure 2:
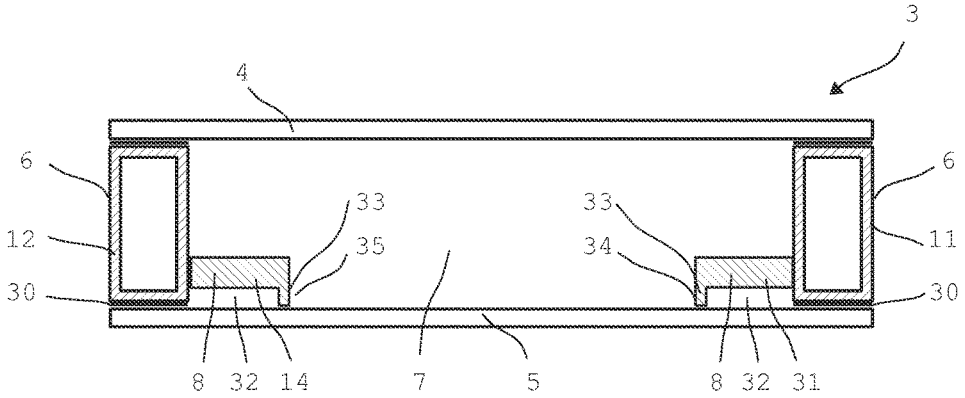
FIG. 2 shows a highly schematic view of a door in a sectional view from above.

FIG. 2 shows a highly schematic view of a door 3 in a sectional view from above. Here, one can see a holding element 6 on the left and on the right which are each made of an aluminum profile 12.

In the embodiment shown here, an inner pane 4 and an outer pane 5 are fastened to the profiled sections 11 by means of a temperature-resistant silicon adhesive 30. When the baking chamber door 3 is closed, the inner pane 4 faces the baking chamber 2, and the outer pane 5 faces outwards. Other fastening methods can also be used advantageously and practically in order to arrange the panes on the holding element 6.

In the area of the outer pane 5, a cooling element 8 is associated with the left-hand and the right-hand aluminum profile 12, said cooling element 8 being a heat sink 31 and being made of a thermally conductive material 14. A different positioning of the cooling element 8 along the profiled sections 11 can also be advantageous. In other embodiments, the profiled sections can be made partially or entirely of sheet metal or of another metal, which can also be enameled. Other heat-resistant materials can also be used in certain cases.

Advantageously, however, the heat sinks are arranged at a distance from the pane 5 so that a free area 32 remains between the pane 5 and the heat sink 31 through which the air can flow.

In order to prevent the cooling elements 8 from inadvertently coming into contact with the pane 5, small support elements 34 are provided as spacers 33, which project here as a small strip 36 from the cooling element 8. They support the cooling element 8 against the outer pane 5, whereby a resilient support is advantageous.

Figure 3:
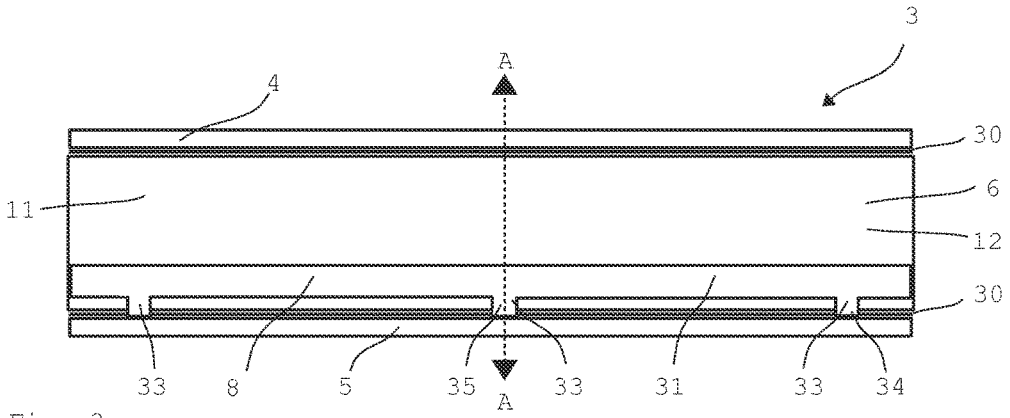
FIG. 3 shows a highly schematic view of the door of FIG. 2 in a sectional view from the ventilation channel.

FIG. 3 shows the door 3 of FIG. 2 in a sectional side view through the middle of the opened door. The line A-A shows the sectional position of the depiction previously described in FIG. 2.

In this embodiment, the heat sink 31 is configured over the entire length of the aluminum profile 12 and is supported against the outer pane 5 in three places 33.

A refinement of the door 3 described above is shown in FIGS. 4 and 5. Here, a slit 13 is provided in the aluminum profiles 12 on the side facing the ventilation channel 7. This slit 13 interrupts the heat transmission from the inner pane 4 to the outer pane 5, thereby improving the cooling of the outer pane 5 in the area of the holding element 6.

The length of the cooling elements 8 in the embodiment shown here is selected such that the heat sinks 31 do not extend into the visible area of the pane 5. Here, the pane 5 has a darkened area 36 as decoration, behind which the heat sinks 31 are arranged so that they are not visible from the outside. In other embodiments, the inner pane 4 can also have such a darkened area 36.

Figure 4:
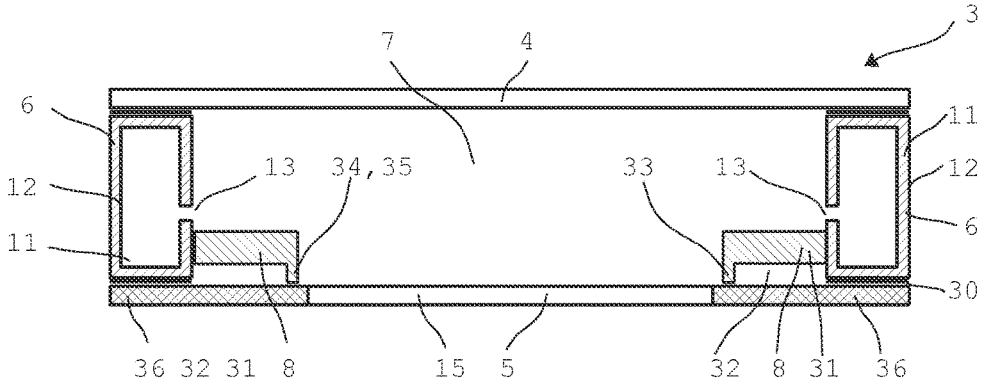
FIG. 4 shows a highly schematic view of a refinement of the door of FIG. 2 in a sectional view from above.
Figure 5:
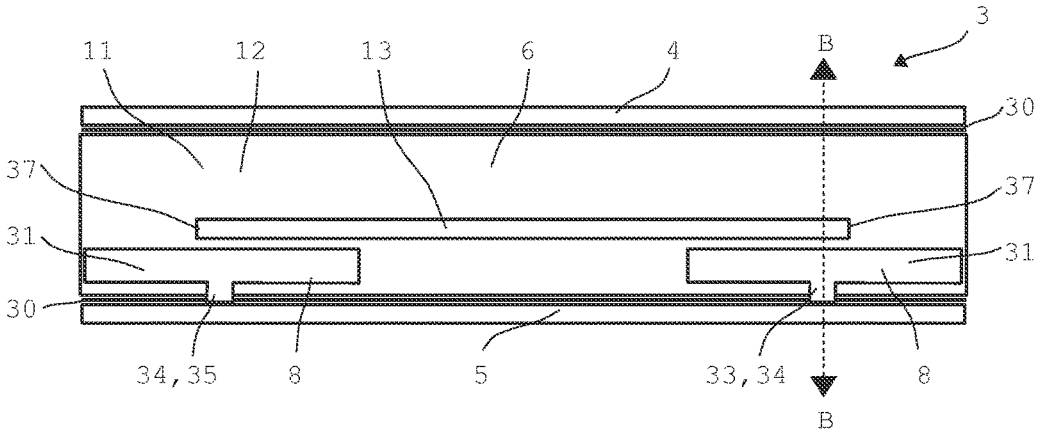
FIG. 5 shows a highly schematic view of the door of FIG. 4 in a sectional view from the ventilation channel.

In FIG. 5, the sectional plane of the door 3 shown in FIG. 4 is drawn with the line B-B. Moreover, one can see that the slit 13 extends over virtually the entire length of the aluminum profile 12. This causes a narrowing of the cooling or thermally conductive element 8.

Other embodiments of the slit 13 are also conceivable and advantageous. For example, several shorter slits 13 can be provided, which can also be configured, for example, to be offset and overlapping. Slits 13 on other sides of the holding element 6 can also be advantageous.

FIG. 5 also shows that the heat sinks 31 do not have to extend over the entire length of the aluminum profile 12. Two short cooling elements 8 are provided which are each supported against the pane 5 via a support element 34. They are arranged in the area of the slit ends 37 where the most of the heat has to be dissipated.

Figure 6:
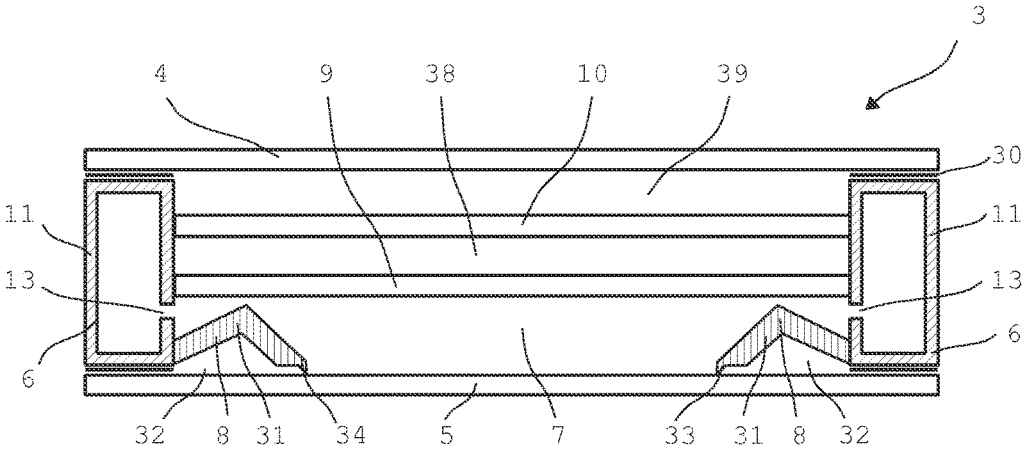
FIG. 6 shows a highly schematic view of another embodiment of a door in a sectional view from above.

FIG. 6 shows another embodiment with a door 3 that, in addition to the inner pane 4 and the outer pane 5, also has two middle panes 9, 10. As a result, a ventilation channel 7 is formed between the outer pane 5 and the one middle pane 9. A ventilation channel 38 is formed between the two middle panes 9, 10, and the ventilation channel 39 is formed between the inner pane 4 and the middle pane 10.

In the embodiment shown here, there is also a slit 13 in the profiled sections 11 which are also provided here as aluminum profiles 12. In the area of the holding elements 6, where the outer pane 5 is secured by means of a heat-resistant silicon adhesive 30, there are heat sinks 31 on each side. In the door 3 shown here, they are configured as V-shaped metal sheets that have very small spacers 33 that support the cooling elements 8 against the outer pane 5. This ensures that a defined free area 32 remains between the heat sinks 31 and the outer pane 5, through which cool air can flow in order to cool the cooling elements 8 from both sides. Other shapes of the cooling elements 8 can also be practical and advantageous. Any design that enlarges the surface area of the cooling element can be used advantageously.

In advantageous embodiments, if the door is structured with more than two panes 4, 5, 9, 10 and thus with several ventilation channels 7, 38, 39, then heat sinks 31 that are in contact with the holding elements 6 can also be provided in each ventilation channel.

For the rest, it lies within the scope of the knowledge of any person skilled in the art to modify the described embodiments in ways not shown here in order to achieve the described effects, without departing from the scope of the invention.

LIST OF REFERENCE NUMERALS

1 baking appliance
2 baking chamber
3 door
4 inner pane
5 outer pane
6 holding element
7 ventilation channel
8 cooling element
9 middle panes
10 middle pane
11 profiled section
12 aluminum profile
13 slit
14 thermally conductive material
15 visible area
17 housing
18 cooktop
19 cooking zone
20 operating element
21 operating panel
22 control unit
23 display device
24 display
25 operating element
26 viewing window
27 rack holder
28 holding rail
29 baking level
30 silicon adhesive
31 heat sink
32 free area

33 spacer
34 support elements
35 strip
36 darkened area
37 slit end
38 ventilation channel
39 ventilation channel

What is claimed is:

1. A baking appliance including a heatable baking chamber and a door that closes the baking chamber, the door comprising:

an inner pane facing the baking chamber when the door is closed;

an outer pane facing outward when the door is closed;

at least one holding element extending between and directly contacting both the inner pane and the outer pane so as to connect the inner pane and outer pane to form at least one ventilation channel between the inner pane and outer pane;

at least one cooling element associated with the at least one holding element, the at least one coding element extending into the at least one ventilation channel, the at least one cooling element being in contact with the at least one holding element so as to conduct heat and thereby dissipate heat from the at least one holding element; and a support element extending from the at least one coding element to support the at least one coding element at a distance from the outer pane so as to provide an air flow space between at least part of the at least one cooling element and the outer pane, wherein the air flow space is bounded by at least the at least one cooling element, the support element, and the outer pane.

2. The baking appliance recited in claim 1, further comprising a middle pane disposed between the inner pane and the outer pane so as to form a ventilation channel between each set of the adjacent panes.

3. The baking appliance recited in claim 2, wherein the at least one cooling element includes a cooling element disposed at least in the ventilation channel between the outer pane and middle pane.

4. The baking appliance recited in claim 1, wherein each holding element at least partially includes profiled sections.

5. The baking appliance recited in claim 4, wherein the profiled sections include aluminum profiles.

6. The baking appliance recited in claim 4, wherein the profiled sections include sheet metal.

7. The baking appliance recited in claim 4, wherein each cooling element is held on a profiled section.

8. The baking appliance recited in claim 4, wherein at least one of the profiled sections includes at least one slit extending substantially vertically when the door is closed.

9. The baking appliance recited in claim 8, wherein the at least one slit is disposed on a side of the corresponding profiled section that faces the ventilation channel.

10. The baking appliance recited in claim 1, wherein the air flow space is bounded by the at least one holding element.

11. The baking appliance recited in claim 1, wherein each cooling element is supported against the outer pane.

12. The baking appliance recited in claim 11, wherein each cooling element is resiliently supported against the outer pane.

13. The baking appliance recited in claim 1, wherein each cooling element is configured so as to have a large surface area.

14. The baking appliance recited in claim 1, wherein each cooling element at least partially includes a thermally conductive material.

15. The baking appliance recited in claim 1, wherein each cooling element does not extend into a visible area of the door.

16. A door for closing a baking chamber opening of a baking appliance, the door comprising:

an inner pane facing the baking chamber when the door is closed;

an outer pane facing outward when the door is closed;

at least one holding element extending between and directly contacting both the inner pane and the outer pane so as to connect the inner pane and outer pane to form at least one ventilation channel between the inner pane and outer pane;

at least one cooling element associated with the at least one holding element, the at least one cooling element extending into the at least one ventilation channel, the at least one cooling element being in contact with the at least one holding element so as to conduct heat and thereby dissipate heat from the at least one holding element; and a support element extending from the at least one cooling element to support the at least one cooling element at a distance from the outer pane so as to provide an air flow space between at least part of the at least one cooling element and the outer pane, wherein the air flow space is bounded by at least the at least one cooling element, the support element, and the outer pane.

17. The baking appliance recited in claim 16, wherein the air flow space is hounded by the at least one holding element.

* * * * *